US012012855B2

(12) United States Patent
Tivas et al.

(10) Patent No.: US 12,012,855 B2
(45) **Date of Patent: *Jun. 18, 2024**

(54) ROTARY BORING MINING MACHINE INERTIAL STEERING SYSTEM

(71) Applicant: The Mosaic Company, Plymouth, MN (US)

(72) Inventors: Roy W. Tivas, Regina (CA); Erik Rasmussen, Yarbo (CA)

(73) Assignee: The Mosaic Company, Tampa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/813,526

(22) Filed: Jul. 19, 2022

(65) Prior Publication Data

US 2022/0349304 A1 Nov. 3, 2022

Related U.S. Application Data

(63) Continuation of application No. 16/990,461, filed on Aug. 11, 2020, now Pat. No. 11,391,150, which is a continuation of application No. 15/700,557, filed on Sep. 11, 2017, now Pat. No. 10,738,609.

(60) Provisional application No. 62/385,550, filed on Sep. 9, 2016.

(51) Int. Cl.

| | |
|---|---|
| ***E21C 35/08*** | (2006.01) |
| ***E21B 3/00*** | (2006.01) |
| ***E21C 35/24*** | (2006.01) |
| ***E21C 41/20*** | (2006.01) |
| ***E21C 41/22*** | (2006.01) |
| ***E21F 13/06*** | (2006.01) |

(52) U.S. Cl.
CPC ..... *E21C 35/08* (2013.01); *E21B 3/00* (2013.01); *E21C 35/24* (2013.01); *E21C 41/20* (2013.01); *E21C 41/22* (2013.01); *E21F 13/066* (2013.01)

(58) Field of Classification Search
CPC ..... E21C 35/08
See application file for complete search history.

(56) References Cited

U.S. PATENT DOCUMENTS

| | | | | |
|---|---|---|---|---|
| 4,046,424 A * | 9/1977 | Montgomery | E21C 35/20 | 299/56 |
| 4,548,443 A * | 10/1985 | Turner | E21D 9/1093 | 299/31 |
| 5,553,407 A * | 9/1996 | Stump | G01V 3/12 | 701/50 |
| 5,667,279 A * | 9/1997 | Christopher | E21C 35/24 | 299/30 |
| 6,203,111 B1 * | 3/2001 | Ollis | E21C 35/24 | 299/1.4 |

(Continued)

OTHER PUBLICATIONS

IEEE Xplore Maps Goes Underground Connie Kirkland Honeywell Inc. Sensor and Guidance Products Guidance and Navigation Operation (Year: 1998).*

*Primary Examiner* — Janine M Kreck
(74) *Attorney, Agent, or Firm* — Husch Blackwell LLP

(57) ABSTRACT

A mining system with an inertial guidance system configured to enable precise excavation of geological material without a need to advance a survey line over a long distance and/or nonlinear excavation path, thereby maximizing productivity of the mind by minimizing a width of un-mined material necessary for support between adjacent excavation paths and minimizing equipment downtime.

12 Claims, 4 Drawing Sheets

(56) References Cited

U.S. PATENT DOCUMENTS

| | | | | |
|---|---|---|---|---|
| 10,738,609 | B2 * | 8/2020 | Tivas | E21C 35/24 |
| 11,391,150 | B2 * | 7/2022 | Tivas | E21C 35/24 |
| 2018/0053406 | A1 * | 2/2018 | Kawamata | G06Q 50/02 |

* cited by examiner

ROTARY BORING MINING MACHINE INERTIAL STEERING SYSTEM

RELATED APPLICATIONS

This application is a continuation of U.S. application Ser. No. 16/990,461 filed Aug. 11, 2020, now U.S. Pat. No. 11,391,150 issued Jul. 19, 2022, which is a continuation of U.S. application Ser. No. 15/700,557 filed Sep. 11, 2017, now U.S. Pat. No. 10,738,609 issued Aug. 11, 2020, which claims the benefit of U.S. Provisional Application No. 62/385,550 filed Sep. 9, 2016, each of which is hereby incorporated herein in its entirety by reference.

FIELD OF THE INVENTION

The present disclosure generally relates to systems and methods for boring or mining a subterranean region, and more particularly to mining systems and methods incorporating an inertial guidance system configured to enable precise excavation of geological material without a need to advance a survey line over a long distance and/or a nonlinear excavation path.

BACKGROUND OF THE INVENTION

Mining is the extraction of minerals or other geological materials from the earth from deposition such as an ore body, lode, vein, seam, reef or placer deposits. Ores recovered by mining can include, for example, metals, coal, oil shale, gemstones, limestone, dimension stone, rock salt, potash, gravel, and clay. Mining is required to obtain any material that cannot be grown through agricultural processes, or created artificially in a laboratory or factory. Mining can be accomplished via a variety of surface or subsurface techniques depending on the location of the deposit to be mined. Mining equipment has been developed for each different type of mining technique. For example, for performing subsurface mining techniques, a variety of below-ground drive prime movers such as, for example, continuous or drum miners, roadheaders, and rotary boring machines, have been developed.

Specifically with respect to potash, potash is a mineral that can be employed in many agricultural uses, such as fertilizers and animal feed. Potash can be found in mineral deposits, such as located in former lake-beds, and thus is often located in horizontal veins underground. Potash mining involves extracting the potash from these veins, often using room-and-pillar style mining and associated equipment, such as rotary boring mining machines. This type of mining, in which "rooms" are extracted from the mineral deposit while leaving "pillars" in between as supports, permits the extraction of a large portion of the vein.

Rotary boring mining machines are used in the underground potash mining to extract the concentrated KCl mineral in a sedimentary form. The mining machines cut the deposit materials, e.g. ore, by forcing rotary cutters into the mining face. For sake of simplicity, the mined or liberated material may be referred to as "ore," but shall not be limited thereto. The liberated material is augured into the center of the machine by counter rotating rotors of the cutters and is conveyed through the middle of the mining machine to the rear by a chain conveyor. The chain conveyor dumps the liberated material onto an extensible conveyor which is operated behind the mining machine and consecutive conveyors delivery the material to a shaft where it is hoisted to the surface, such as by a skip, for further processing.

To maximize production, the extensible conveyor needs to be installed precisely behind the miner machine as mining progresses so the hardware of the system is perpendicular to the direction of the mining (i.e. face) and is centered on the conveyor line. This alignment ensures that the system operates effectively while minimizing spillage and damaging hardware due to the conveyor belt(s) running off-center and rubbing on the side of the hardware. The extensible conveyors are installed using a special bridge that is operably coupled to the mining machine with linkages and hydraulic cylinders, which provide four degrees of freedom to allow the bridge to be moved side-to-side and rotated left-or-right to ensure that the mining machine remains centered and aligned perpendicular to the mining face.

Furthermore, in order to extract the largest portion of the mineral deposits possible, it is preferable to maximize the ratio of room to pillar. Consequently, the use of extensible conveyors results in long rooms with narrow pillars between them. The placement of the pillars is also important in preventing loss of structural support to the mine. Thus, ideally, the pillars are made as narrow as possible between the rooms, while being precisely placed in order to provide sufficient structural support to ensure that the mine will not collapse. To accurately and precisely place pillars, rooms are often excavated using laser sight sensing devices. Otherwise, deviation from a straight bore would cause the pillar on one side of the room to become thicker, while decreasing the thickness of the pillar on the other side, potentially compromising the structural integrity of the mine overall. In conventional systems, such as rotary mining machine systems, the heading control consists of surveyors using theodolites to advance control spads. A pencil beam laser and rotary laser are positioned behind the spads so as to shine the laser light through plum bob strings suspended from the spads. The laser light projects a target on the front of the mining machine which the mining machine operators can observe and control the steering to maintain the laser on the target.

The laser sensing devices have been used as the target on the front of the mining machines which provides deviation information to the programmable logic controller (PLC). The PLC interprets the deviation data and provides steering control to automatically maintain the design heading. Although the extensible bridge motion is articulated from the mining machine, it gets the control information from the same laser that the mining machine uses. The laser strikes a pair of laser planes mounted on the bridge and the deviation information is translated into linear and rotational instructions that the bridge hydraulics execute. Continuous monitoring and corrective motion maintains the bridge and extensible conveyor in the proper alignment when installed and working properly.

However, using lasers and laser sensing elements for guidance has several limitations. The laser light loses strength the further it is away from the target, so as the mining machine cuts the face and advances, the operators have an increasingly difficult time seeing the laser light. Additionally, the sedimentary seam undulates and the mining machine is required to stay within a prescribed geological horizontal zone. As this horizontal zone undulates and the mining machine cuts higher or lower accordingly, the laser light strikes the roof or other structure or equipment which prevents the laser light from reaching the desired target on the front of the mining machine and bridge.

Advancing the survey line and lasers is time consuming and requires the mining machine to be shut down for approximately an hour or more while this work is done.

Advancing the survey line is typically done by two groups of people: the surveyors and the miner operators. The surveyors use sophisticated surveying equipment that is very precise and ensures that the control spads are correctly and accurately aligned. The operators use the laser light that is several hundred feet back to install new control spads near the mining machine. This is less precise than using a survey instrument as the laser light is a quarter inch thick and is not perfectly aligned with the spads nearest to the lasers and so the error is multiplied when projected several hundred feet away. Occasionally there can be large deviations that require a heading correction, which results in conveyor alignment problems.

Conventional systems, using lasers and laser sensing elements such as detectors, have been used previously with limited success because the laser sensing element mounted on the front of the mining machine that was used for automated control loses sight of the laser very quickly as the mining machine is controlled up or down according to the undulating nature of the sedimentary ore body. The constant need to advance the survey line and laser equipment makes the conventional system undesirable.

As the mining equipment advances, pushing the face back into the potash vein for cutting, the conveyor system must be capable of following and remaining closely aligned with one another and with the mining equipment to prevent or inhibit the mined material from falling off the conveyor system, which could create inefficiencies, delays, or hazards. As the conveyor systems can reach several kilometers in length, slight misalignment can easily occur. Often, the locomotive force to advance the conveyor towards the face is provided via the mining equipment, and the conveyor and bridges must be capable of remaining sufficiently aligned with one another and with the mining equipment to operate reliantly and efficiently.

Furthermore, errors in laser alignment increase with distance from the source of the laser beam. Errors in laser beam angle result in increasing error in mining equipment positioning, proportional to the distance from the laser beam source. Errors in setup and alignment of the laser beam source made as the mining equipment is advanced can also compound one another to result in changes in heading, which can cause offset in angle or position along the conveyor system.

There remains a need for a more robust guidance system which reduces position errors and therefore increases mining efficiencies.

SUMMARY OF THE INVENTION

Embodiments of the present disclosure provide an inertial guidance system for mining machines and methods of mining with advanced directional guidance configured to enable precise excavation of geological material without a need to advance a survey line over a long distance and/or a nonlinear excavation path, thereby maximizing productivity of a mine by minimizing a width of un-mined material necessary for support between adjacent excavation paths and minimizing equipment downtime. In one embodiment, the mining system includes a mining machine, a conveyor chain, and an inertial guidance system.

The mining machine can have a steerable drive mechanism configured to advance the mining machine along an intended excavation path, a cutting mechanism configured to separate geological material from a wall of the excavation path, an auger mechanism configured to collect the separated geological material, and a conveyor mechanism configured to convey the collected geological material to a rear of the mining machine. The conveyor chain can be configured to convey the geological material to a mine exit.

The inertial guidance system can be configured to sense movement of the mining machine and provide directional guidance as an aid in guiding the steerable drive mechanism along the intended excavation path. The inertial guidance system can include at least three accelerometers, at least three gyroscopes, and a programmable logic controller. Individual accelerometers of the at least three accelerometers can be configured to sense acceleration along x-, y- and z-axes respectively. Individual gyroscopes of the at least three gyroscopes can be configured to sense rotation about the x-, y- and z-axes respectively. The programmable logic controller can be configured to receive sensed acceleration data from the at least three accelerometers and/or rotational data from the at least three gyroscopes. With this data, the programmable logic controller can determine movement of the mining machine is a function of time, and compute directional guidance to maintain advancement of the mining machine along the intended excavation path.

In one embodiment, the inertial guidance system further includes a memory in which the movement of the mining machine as a function of time is stored. In one embodiment the inertial guidance system further includes a display. In one embodiment the display is configured to graphically display movement of the mining machine as a function of time. In one embodiment the display is configured to graphically display comparison of the intended excavation path to an actual excavation path of the mining machine. In one embodiment the display is further configured to graphically display previous excavation paths excavated by the mining machine, as well as un-mined material necessary for support of adjacent excavation paths in a map format. In one embodiment, the display is configured to graphically display the computed directional guidance to the mining machine. In one embodiment the inertial guidance system further includes a communication bus configured to transmit the computed directional guidance to the steerable drive mechanism. In one embodiment the steerable drive mechanism is configured to automatically steer the mining machine according to the directional guidance.

Another embodiment of the present disclosure provides a method for providing directional guidance to a mining system, so as to enable precise excavation of geological material without a need to advance a survey line over a long distance and/or a nonlinear excavation path, thereby maximizing productivity of the mine by minimizing a width of un-mined material necessary for support between adjacent excavation paths and minimizing equipment downtime. The method can comprise: providing a mining machine having an inertial guidance system including at least three accelerometer is, wherein at least one accelerometers configured to sense acceleration along an x-axis of the mining machine, at least one accelerometer is configured sense acceleration along a y-axis of the mining machine, and at least one accelerometer is configured to sense acceleration along a z-axis of the mining machine; at least three gyroscopes, wherein at least one gyroscope is configured to sense rotation about an x-axis of the mining machine, at least one gyroscope is configured to sense rotation about a y-axis of the mining machine, at least one gyroscope is configured to sense rotation about a z-axis of the mining machine; and a programmable logic controller configured to receive sensed acceleration data from the at least three accelerometers and rotation data from the at least three gyroscopes, and compute directional guidance in order to maintain a prescribed heading; advancing the mining machine along an intended excavation path; sensing movement of the mining machine; determining movement of the mining machine is a function of time; and providing directional guidance to maintain advancement of the mining machine along the intended excavation path.

It should be understood that the individual steps used in the methods of the present teachings may be performed in any order and/or simultaneously, as long as the teaching remains operable. Furthermore, it should be understood that the apparatus and methods of the present teachings can include any number, or all, of the described embodiments, as long as the teaching remains operable.

The summary above is not intended to describe each illustrated embodiment or every implementation of the present disclosure. Rather, the embodiments are chosen and described so that others skilled in the art can appreciate and understand the principles and practices of the invention. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
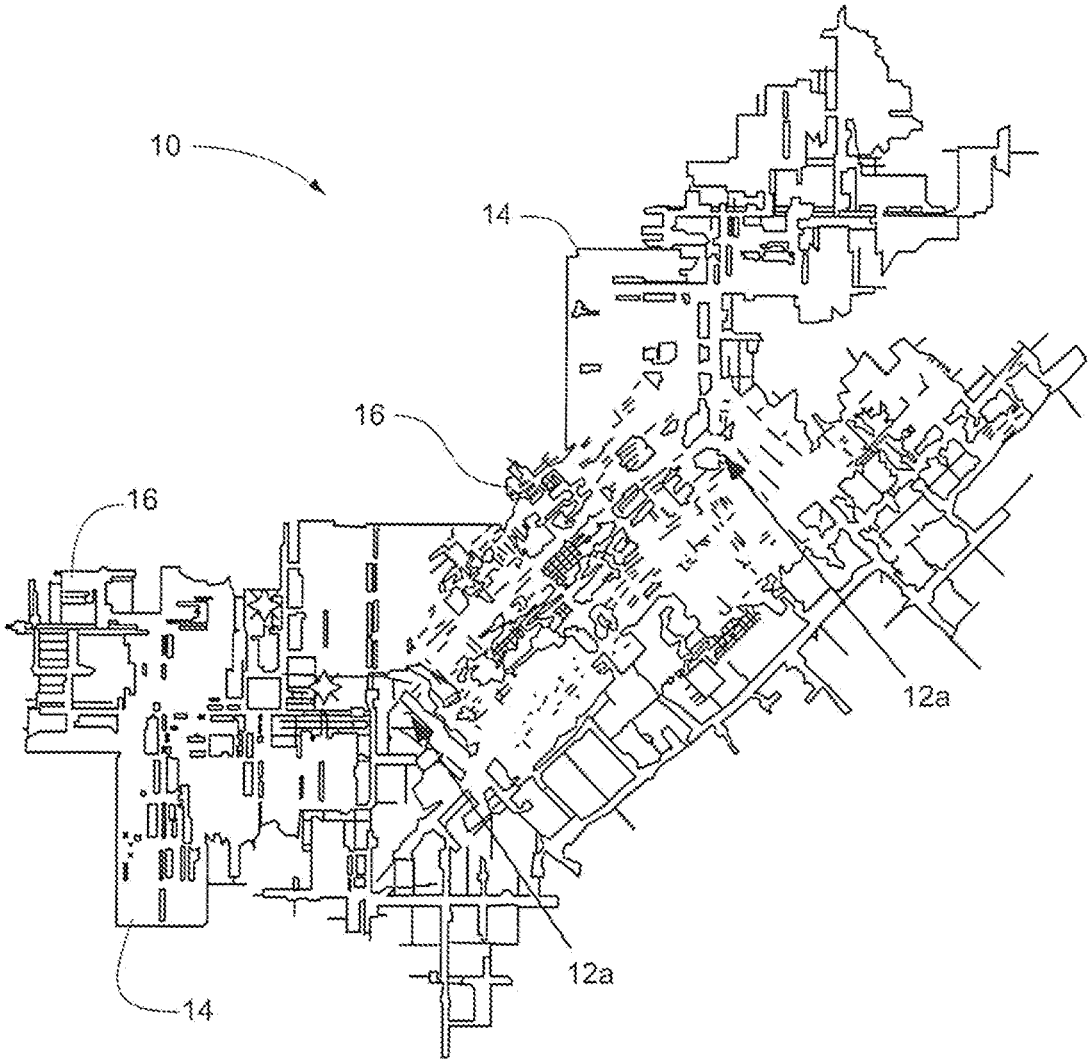
FIG. 1 is a map view depicting a potash mine.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION OF THE DRAWINGS

According to embodiments, apparatus and methods for a mining system, such as room-and-pillar mining, are disclosed. The guidance system comprises an inertial system, rather than or in addition to conventional laser beam guidance. By using an inertial guidance system, downtime for mining equipment can be minimized, and the heading of the mining equipment can be controlled more accurately over both longer distances and non-linear excavation paths.

Referring to FIG. 1, a map view of an example potash mine 10 is depicted. Specifically, FIG. 1 depicts a room-and-pillar structure type mine, including mineshafts 12*a* and 12*b*, connected to a network of rooms 14 or excavated paths (depicted as shaded regions) with pillars 116 or un-mined material necessary for support (depicted as un-shaded regions) positioned between adjacent rooms 14. Mineshafts 12*a* and 12*b* are often several hundred meters long, extending from the surface (not shown) to the subterranean geological material and/or mineral deposits below. In some cases, the mineshafts 12*a* and 12*b* extend substantially vertically, primarily perpendicular to the map view depicted in FIG. 1.

Rooms 14 follow the vein of subterranean geological material. Potash mines, in particular, can be quite extensive in size; for example, a typical potash mine can extend over several hundred square kilometers. As the mine 10 is constructed, and the network of rooms 14 are excavated and geological material transported to the surface, pillars 16 of un-excavated material are left in place to provide structural support to maintain the integrity of the rooms 14. Accordingly, during mining operations, care must be taken to ensure that the pillars 16 have a size sufficient to provide the needed structural support. Pillars 16 of insufficient size may lead to a collapse, or partial collapse, of one or more of the adjacent rooms 14.

Figure 2:
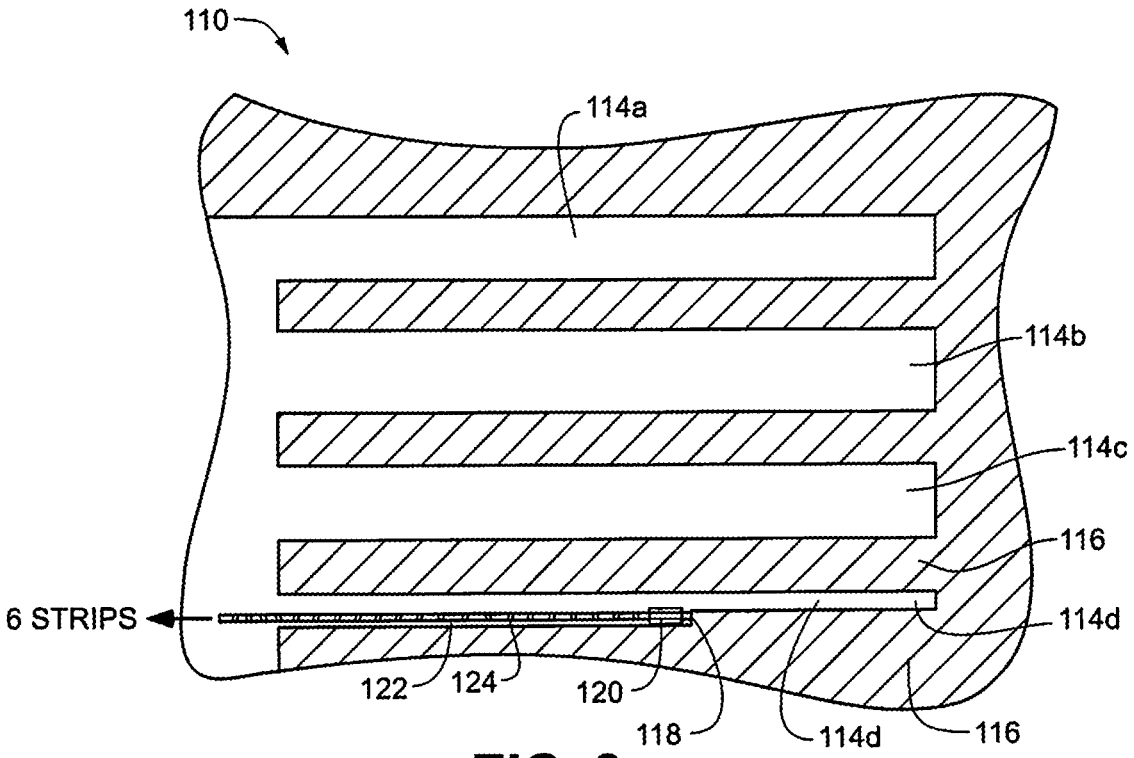
FIG. 2 is a cross-sectional view depicting several rooms of a mine under construction.

Referring to FIG. 2, a cross-sectional view of a mine 110 under construction is depicted. Mine 110 includes three completed rooms 114*a*, 114*b*, and 114*c*, as well as a fourth room 114*d* under construction. Mine 110 further includes pillars 116. One end of the fourth room 114*d* defines a face 118, which is the portion of the unfinished room 114*d* from which geological material is being excavated or separated from the earth. As depicted, a mining machine 120 is arranged adjacent to the face 118 to affect the excavation. A conveyor chain 122 including a plurality of bridges 124 is positioned at the rear of the mining machine 120, opposite from the face 118, in order to transport the geological material to a mine exit.

As depicted in FIG. 2, adjacent rooms 114*a*-114*d* are separated from one another by pillars 116. As previously described, the pillars 116 provide structural support for mine 110, thereby enabling the excavation of geological materials to safely take place in rooms 114*a*-114*d*. To maximize productivity of the mine by excavating as much geological material as possible, while ensuring adequate structural support, it is generally desirable that the rooms 114*a*-114*d* extend as close to parallel to one another as is structurally possible. Accordingly, the face 118 is generally substantially perpendicular to the direction in which the rooms 114*a*-114*d* extend.

Figure 3A:
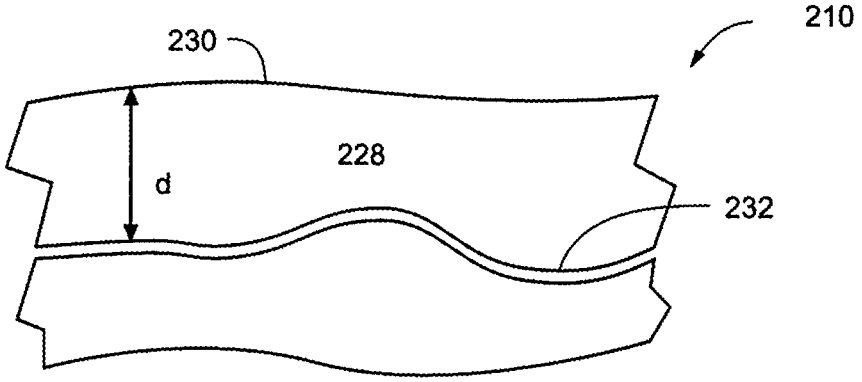
FIG. 3A is a cross-sectional view depicting an undulating mineral deposit.
Figure 3B:
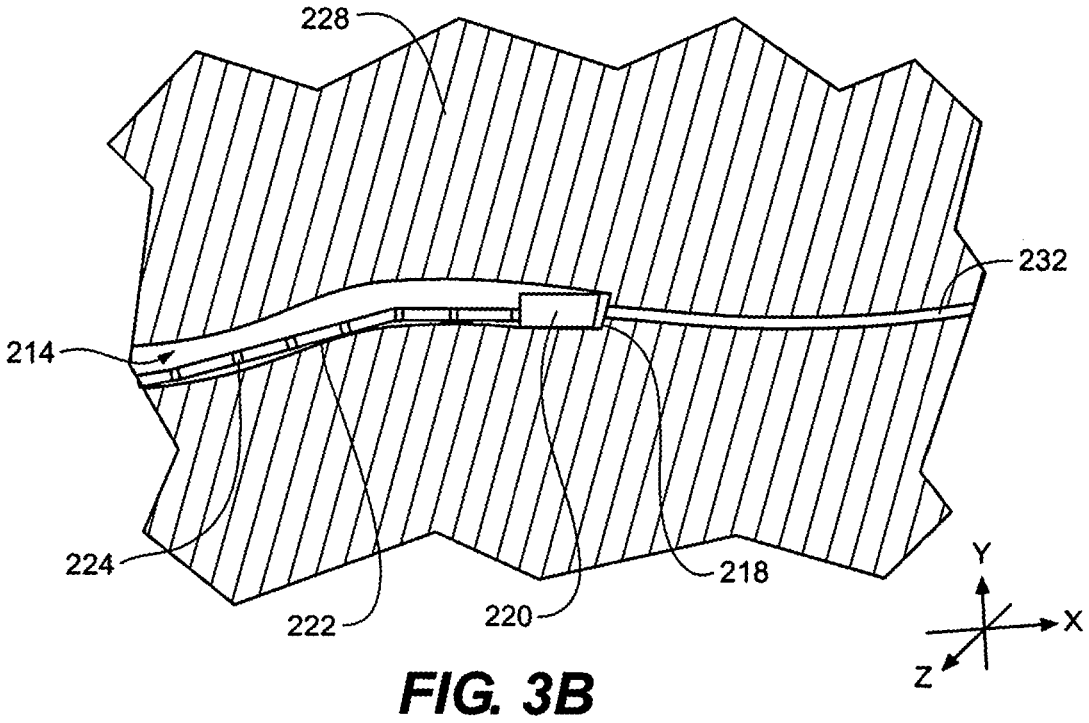
FIG. 3B is a cross-sectional view depicting a mining system with advanced directional guidance, mining the vein shown in FIG. 3A, in accordance with an embodiment of the disclosure.

Referring to FIGS. 3A-B, a cross-sectional view of the earth depicting an undulating subterranean mineral deposit is depicted. In such a deposit, a vein of geological material 232 is positioned beneath a layer of non-mineral earth 228, which can vary in depth D from the earth's surface 230. Accordingly, efficient mining of such a deposit may require a nonlinear excavation path, or a network of rooms that vary in elevation so as to be centered on the vein of geological materials 232.

As depicted in FIG. 3B, a mining machine 220 in accordance with an embodiment of the disclosure can be configured to follow the non-planar vein of geological material 232. Accordingly, the mining machine 220 can be advanced along the vein to separate the geological material 232 from the face 218 of the room 214 being excavated. The separated geological material 232 can then be collected and conveyed to a rear of the mining machine 120. At the rear of the mining machine 120, a conveyor chain 222, which may include a plurality of bridges 224, can cooperate to move or convey the geological material 232 towards a mine exit, such as a mine shaft. Thereafter, the geological material 232 can be transported to the earth's surface 230 for further processing and transport. Accordingly, an advantage of incorporating an inertial guidance system of the present disclosure, as opposed to conventional laser-based systems of the prior art, is the ability to track changes in speed and or direction of the mining machine 120 where excavation does not take place along a straight line or linear path, thereby reducing the downtime associated with advancing a laser-based survey line.

Figure 4A:
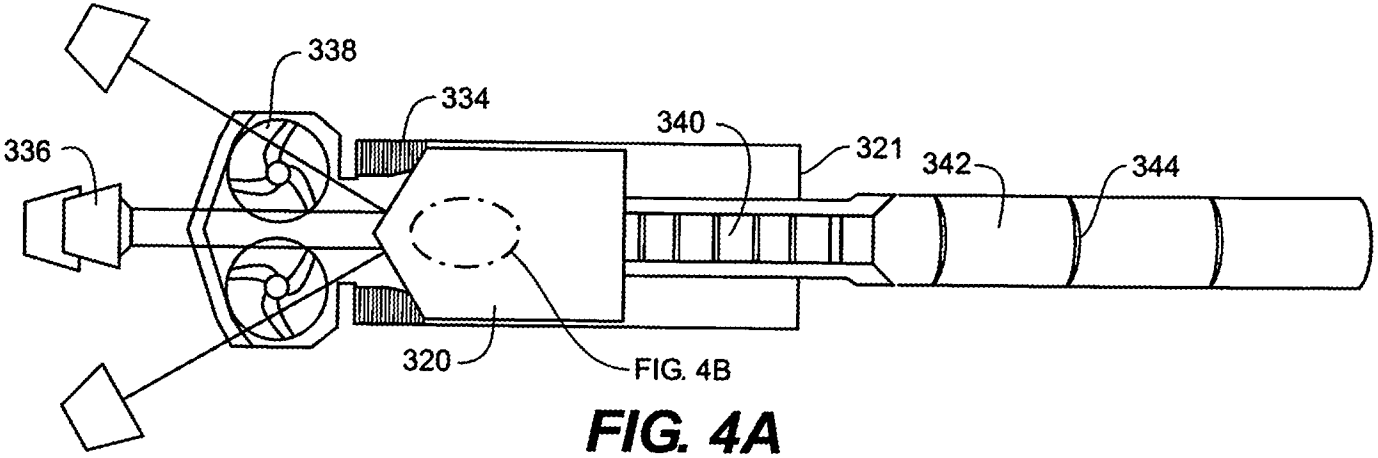
FIG. 4A is a schematic view depicting a mining machine in accordance with an embodiment of the disclosure.
Figure 4B:
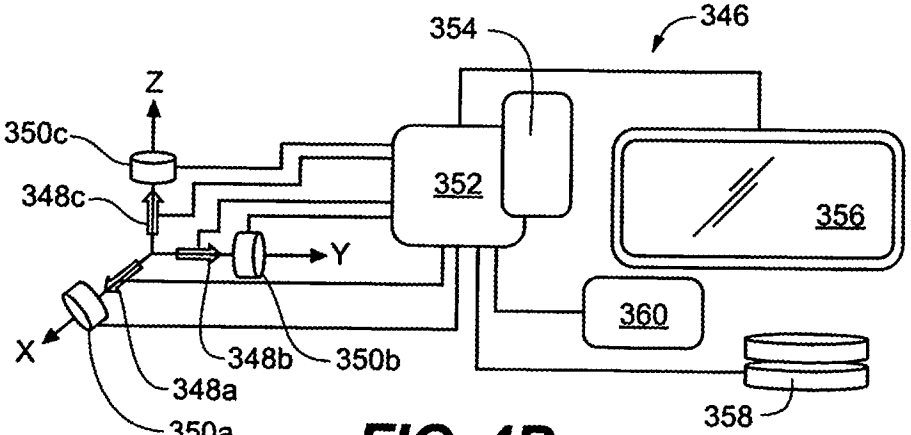
FIG. 4B is a schematic view depicting an inertial guidance system of the mining machine of FIG. 4A.

Referring to FIGS. 4A-B, a mining machine 320 is depicted in accordance with an embodiment of the disclosure. In one non-limiting example, the mining machine 320 can be used in underground potash mining to extract concentrated KCl containing ore in a sedimentary formation. The mining machine 320 can be, for example, any of a variety of prime movers with a cutting or mining mechanism, such as, for example, a rotary boring mining machine, roadheader, continuous or drum miner, or the like. The height of the mining machine 320 can be complementary to the thickness of the seam or vein of geological material to be extracted. For example, the mining machine 320 can be of a height of 8 feet 2 inches, 8 feet 6 inches, or 9 feet. Other heights of mining machine 320 are also contemplated.

In one embodiment, the mining machine 320 can include a steerable drive mechanism 334 as a prime mover. For example, in one embodiment, the steerable drive mechanism 334 can include wheels and/or tracks configured to advance the mining machine 320 along an intended excavation path.

The mining machine 320 can further include a cutting mechanism 336. The cutting mechanism 336 can be configured to separate geological material from a wall or face of an excavation path. In some embodiments, the cutting mechanism 336 can be configured to move relative to a body of the mining machine through range of motion both laterally side to side and vertically up and down to effect separation of geological material from a wall of the excavation path. In some embodiments, the mining machine 320 can include either two or four rotary boring cutter heads, commonly referred to as two-rotor and four-rotor mining machines. A cutting mechanism 336 including alternative quantities of cutter heads or alternative cutting mechanisms is also contemplated.

The mining machine 320 further includes an auger mechanism 338 configured to collect the separated geological material for deposit on a conveyor mechanism 340. The conveyor mechanism 340 is configured to convey the collective geological material to a rear 321 of the mining machine 320.

A conveyor chain 322 can be operably coupled to the rear 321 of the mining machine 320. The conveyor chain 322 can be configured to convey the geological material to a mine exit, where it can be hoisted to the surface for further processing and/or transport. The conveyor chain 322 can include one or more conveyor sections 342 operably coupled to one another by one or more bridges 344, configured to provide four degrees of freedom to enable the conveyor chain 322 to be moved side-to-side (yaw) and/or rotated left-or-right (roll) in order to ensure it remains centered and aligned substantially perpendicular to the face.

Referring to FIG. 4B, the mining machine 320 can further include an inertial guidance system 346. The inertial guidance system 346 can be configured to sense movement of the mining machine 320 and provide directional guidance as an aid in guiding the steerable drive mechanism 334 along the intended excavation path. In some embodiments, the directional guidance is provided visually or audibly to an operator, whom manipulates controls to affect steering. In other embodiments, the directional guidance is provided as data to a steerable drive controller 360 (as depicted in FIG. 4B) configured to autonomously control and/or assist an operator in steering the mining machine 320.

The inertial guidance system 346 can include one or more accelerometers 348 and one or more gyroscopes 350. As depicted in FIG. 4B, the inertial guidance system 346 includes three accelerometers 348*a-c* configured to sense acceleration along respective x-, y- and z-axes of the mining machine 320. The inertial guidance system 346 additionally includes three gyroscopes 350*a-c* configured to sense rotation respectively about x-, y- and z-axes of the mining machine 320. A programmable logic controller 352 can be operably coupled to the at least one accelerometer 348 and gyroscopes 350, so as to receive the sensed acceleration and rotational data. The received data can be utilized to determine the movement of the mining machine 320 as a function of time. Thereafter, directional guidance to maintain advancement of the mining machine 320 along an intended excavation path can be computed.

In some embodiments, the inertial guidance system 346 can further include a communication bus 354 configured to communicate at least one of the sensed acceleration and rotational data, the determine movement of the mining machine 320 is a function of time, and/or the computed directional guidance to maintain advancement of the mining machine 320 along an intended excavation path to an external receiver communicatively coupled to, for example, a server utilized in the planning and execution of mining operations. Various graphic displays can be computed from the communicated information, for example movement of the mining machine as a function of time, a comparison of the intended excavation path to an actual excavation path, previous excavation paths excavated by the mining machine 320, as well as un-mined material necessary for support in a map format, and computed directional guidance of the mining machine 320. In one embodiment, the inertial guidance system 346 includes its own display 356 for display of one or more graphic displays. The inertial guidance system 346 can further be configured with a memory 358 to permanently or temporarily store such information for later recall.

In one embodiment, the one or more bridges 344 of the conveyor chain 322 can additionally include an inertial guidance system similar to the inertial guidance system 346 as described above. In particular, in certain embodiments, the one or more bridges 344 can be configured to sense acceleration and rotation about respective x-, y- and z-axes of the bridge 344, thereby providing information regarding operability of the conveyor chain 322 to an operator. For example, in one embodiment, the inertial guidance system of a bridge 344 can include at least three accelerometers, at least three gyroscopes, a programmable logic controller, and a communication bus. In some embodiments, an inertial guidance system can be included in each bridge of the conveyor chain 322. In other embodiments, an inertial guidance system can be included in certain selected bridges 344 of the conveyor chain, thereby providing an estimated position of the entire conveyor chain 322.

With reference to FIGS. 2 and 4A-4B, in operation, a mine 110 is constructed by extracting material from rooms 114*a*-114*d* while leaving pillars 116 in place between and around the rooms 114*a*-114*d* to provide structural support. Accordingly, mining machine 320 is advanced along an intended excavation path while cutting geological material (e.g., ore), by forcing a cutting mechanism 336 into the mining face 118. The liberated ore can then be augured into the center of the mining machine 320, for example, by counter rotating rotors of an auger mechanism 338, and conveyed through the middle of the mining machine 320 by the conveyor section 342. The use of a conveyor chain 322 typically results in long rooms 114*a*-114*d* having narrow un-mined support pillars 116 positioned therebetween. The length of rooms can be, for example, between about 2500 feet and about 9000 feet, depending on the mining equipment and layout. Such a layout requires that the mining machine 320 closely follow a prescribed heading to prevent encroachment on the narrow pillar 116 that provides structural support for rooms 114*a*-114*d*.

The ore can then be conveyed along a series of conveyor sections 342, which can be linked with one another and with the mining machine 320 by bridges 344, which is operated behind the mining machine 320. The conveyor chain 322 then conveys the ore to a shaft (e.g., shaft 12A or 12B of FIG. 1), where it is hoisted to the earth's surface for further transport and/or processing.

In contrast to the conventional systems using laser sensing technology, as described in the Background section, mining machine 320, conveyor sections 342, and/or bridges 344 of the present disclosure can be aligned with one another using an inertial guidance system 346 including a combination of motion and rotation sensors (e.g. accelerometers 348 and gyroscopes 350). As the mining machine 320 advances towards the face 118, identifying location data can be measured by the inertial guidance system 346. For example, the mining machine 320 can determine acceleration and/or rotation along various directions, such as pitch, yaw, roll, forward or backward acceleration (wherein "forward" is towards the face 118), upward or downward acceleration (wherein "downward" is along the gravitational potential), or left to right acceleration (wherein left and right are the two directions orthogonal to both forward and downward directions). This acceleration and/or rotation data can be used to ascertain movement of the mining machine 320 and/or conveyor chain 322 as a function of time. By integrating the acceleration and/or rotation data twice, a position of the mining machine 320 and/or conveyor chain 322 in Euclidean space can be determined.

In some embodiments, the inertial guidance system 346 can record location history so that conveyor chain 322 can be positioned behind mining machine 320 and reduce the quantity of spillage that could otherwise result from misaligned systems. That is, no laser sight is necessary for bridge 344 alignment use as in systems of the prior art. Additional sensing devices can be used to calculate the position and rotation of the bridges 344 and/or conveyor chain 322 relative to the mining machine 320. The inertial guidance system 346 can be in communication with the bridges 344 to receive and transmit positional data. The system can further be configured to provide a graphic display to the operator for manual use or to automatically control the mining equipment 120. Information generated by the inertial guidance system 346 can be stored in a memory 358 for later recall.

In such systems, utilizing inertial guidance systems 346 (with or without laser guidance systems), the mining machine 320 and conveyor chain 322 need not be arranged along a straight line or linear path. Rather, the mining machine 320 can be driven along a vein of potash or other material that results in capturing the most geological material and in a manner that maintains an appropriate room-and-pillar arrangement (i.e., provides adequate support), whether or not the path taken by the mining equipment 320 is along a plane or constant elevation. In contrast to laser sight systems, this allows mining equipment to follow undulations in a vein without stopping to recalibrate.

In embodiments where the position of mining machine 320 is stored, trailing conveyors sections 342 and bridges 344 can be routed along the same path that was taken by the mining machine 320, or another path that prevents spillage of the ore. Accordingly, survey control is only needed at the start of the room and therefore production delays during each shift can be reduced or eliminated. In some embodiments, the mining machine 320 can be automatically controlled to steer and/or correct heading over extended distances. For example, the mining machine 320 can be operated without an operator in the control canopy, potentially reducing the labor required to operate the mining machine 320.

In embodiments, the rooms 114*a*-114*d* need not be exactly parallel to one another. For example, as previously depicted in FIG. 1, the rooms 14 can be arranged parallel one another, perpendicular to one another, or in any other orientation that provides sufficient support to the back of the mine and permitting extraction of materials such as potash from the mine. In any event, the incorporation of an inertial guidance system 346 into mining operations is advantageous in that it enables the determining the precise location of mining machine 320 and/or conveyor chain 322, whether or not those elements are arranged along a straight line as is required in conventional laser-sighting systems. Furthermore, inertial guidance systems (especially those that do not travel along a straight path) can allow the mining machine 320 to operate for long periods of time and/or long distances without stopping to recalibrate position, unlike laser-sighting systems which must be stopped to advance the laser every so often.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that embodiments may comprise fewer features than illustrated in any individual embodiment described above. The embodiments described herein are not meant to be an exhaustive presentation of the ways in which the various features may be combined. Accordingly, the embodiments are not mutually exclusive combinations of features; rather, embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. An inertial guidance mining system to enable precise excavation of geological material without a need to advance a survey line over a long distance and/or a nonlinear excavation path, the inertial guidance mining system comprising:

a mining machine having a steerable drive mechanism configured to advance the mining machine along an intended excavation path;

a bridge operably coupled to the mining machine, the bridge being configured to align behind the miner machine to aid installation of hardware of a conveyor assembly behind the mining machine, an inertial guidance system configured to sense movement of the mining machine and provide directional guidance as an aid in guiding the steerable drive mechanism along the intended excavation path, the inertial guidance system including— at least one accelerometer configured to sense acceleration along an x-axis of the mining machine, along a y-axis of the mining machine, and/or along a z-axis of the mining machine;

at least one gyroscope configured to sense rotation about the x-axis of the mining machine, rotation about the y-axis of the mining machine, and/or rotation about the z-axis of the mining machine;

a programmable logic controller configured to receive sensed acceleration data from the at least one accelerometer and/or rotation data from the at least one gyroscope, determine movement of the mining machine as a function of time, compute directional guidance to maintain advancement of the mining machine along the intended excavation path, and aid in maintaining the bridge in alignment with the mining machine; and a memory configured to store the movement of the mining machine as a function of time.

2. The inertial guidance mining system of claim 1, wherein the inertial guidance system does not rely on laser-based sensors for computing the directional guidance.

3. The inertial guidance mining system of claim 1, wherein the inertial guidance system is configured to track changes in speed or direction of the mining machine and compute directional guidance based on the changes in speed or direction to maintain advancement of the mining machine along the intended, nonlinear excavation path.

4. The inertial guidance mining system of claim 1, wherein the intended, nonlinear excavation path is a non-planar excavation path.

5. The inertial guidance mining system of claim 1, wherein the inertial guidance system comprises at least three accelerometers, each of the three accelerometers being configured to sense acceleration of the mining machined along the x-axis of the mining machine, the y-axis of the mining machine, and the z-axis of the mining machine respectively.

6. The inertial guidance mining system of claim 1, wherein the inertial guidance system comprises at least three gyroscopes, each of the three gyroscopes being configured to sense rotation of the mining machined about the x-axis of the mining machine, the y-axis of the mining machine, and the z-axis of the mining machine respectively.

7. The inertial guidance mining system of claim 1, wherein the directional guidance is provided as visual or auditory information to an operator who manipulates controls of the steerable drive mechanism to affect steering.

8. The inertial guidance mining system of claim 1, wherein the inertial guidance system further includes a display that displays information regarding the directional guidance.

9. The inertial guidance mining system of claim 8, wherein the display is configured to graphically display the movement of the mining machine as a function of time.

10. The inertial guidance mining system of claim 8, wherein the display is configured to graphically display a comparison of the intended, nonlinear excavation path to an actual excavation path of the mining machine.

11. The inertial guidance mining system of claim 1, wherein the inertial guidance system further includes a communication bus configured to transmit the computed directional guidance to the steerable drive mechanism.

12. The inertial guidance mining system of claim 1, wherein the mining system further includes a conveyor chain comprising a plurality of bridges that couple the one or more conveyor sections together, and wherein the inertial guidance mining system further includes a second inertial guidance system configured to determine movement of the at least one bridge as a function of time, and compute directional guidance to the at least one bridge to maintain the alignment of the conveyor chain.

* * * * *